United States Patent [19]

Weeks

[11] 4,041,857

[45] Aug. 16, 1977

[54] TRASH COMPACTOR

[75] Inventor: Charles B. Weeks, Boston, Mass.

[73] Assignee: Norris Industries, Inc., Los Angeles, Calif.

[21] Appl. No.: 695,258

[22] Filed: June 11, 1976

[51] Int. Cl.[2] ..... B30B 15/30

[52] U.S. Cl. ..... 100/215; 100/229 A; 100/255; 141/73; 141/391; 193/34

[58] Field of Search ..... 100/215, 255, 229 A; 193/33, 34; 53/124 B; 141/73, 80, 391

[56] References Cited

U.S. PATENT DOCUMENTS

| | | | |
|---|---|---|---|
| 3,601,953 | 8/1971 | Boyd | 100/229 A |
| 3,772,984 | 11/1973 | Karls | 100/229 A |
| 3,807,299 | 4/1974 | Engebretsen | 100/229 A |
| 3,903,790 | 9/1975 | Gladwin | 100/229 A |

*Primary Examiner*—Billy J. Wilhite

[57] ABSTRACT

The door of a trash compactor has an auxiliary door located to permit trash to be entered through it into the throat of the compactor. The auxiliary door, when closed, includes a throat portion which converts into a chute when the auxiliary door is opened.

10 Claims, 6 Drawing Figures

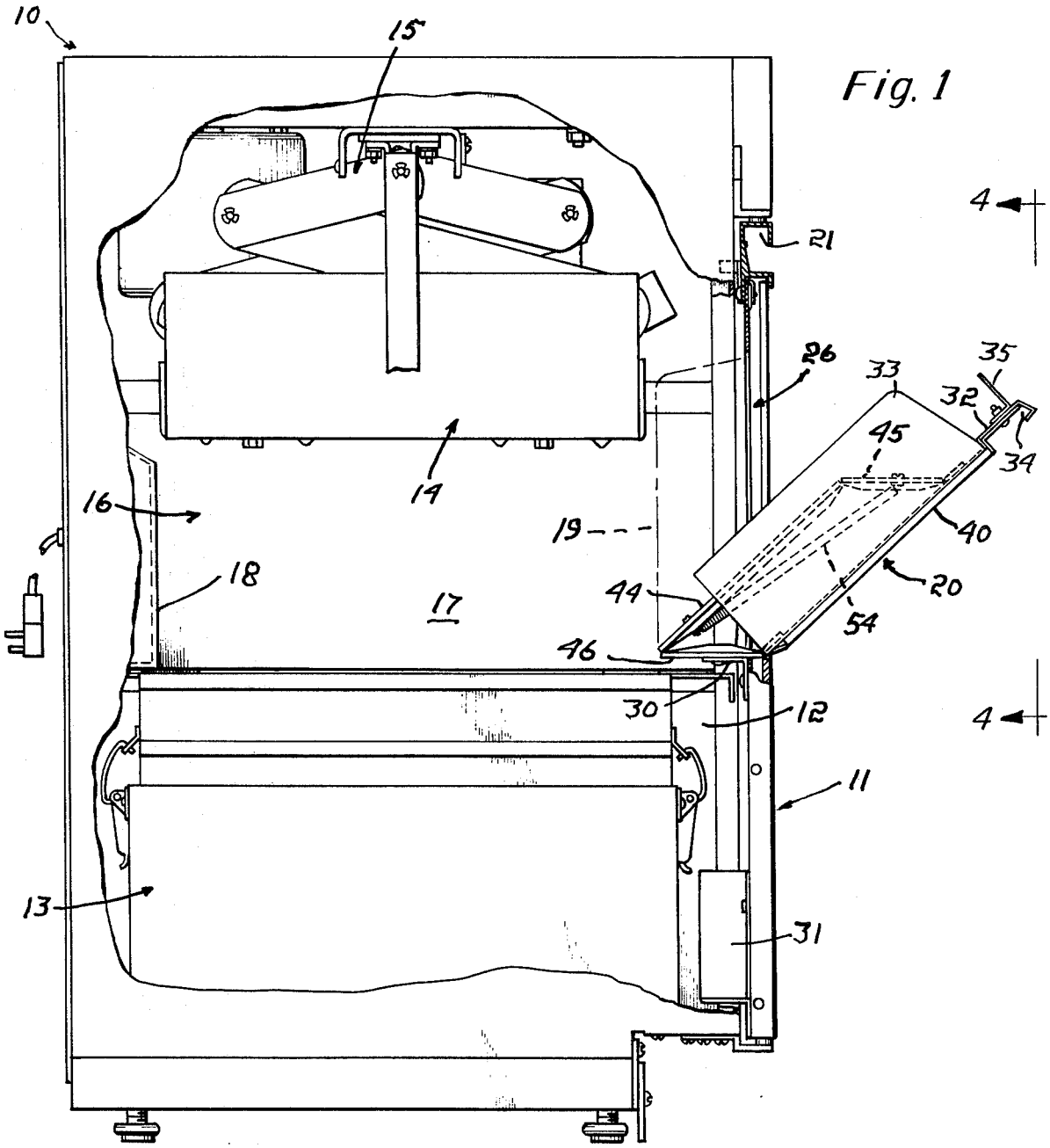
Fig. 2
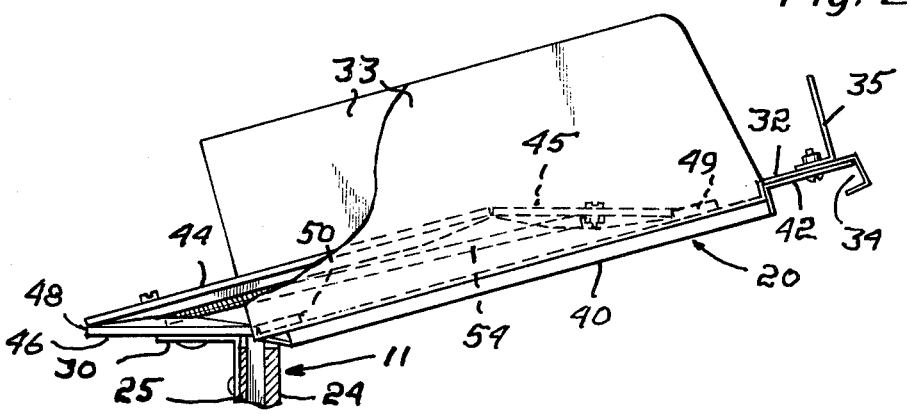

TRASH COMPACTOR

BACKGROUND REFERENCES

U.S. Pat. Nos. 3,601,953, 3,772,984, 3,807,299 and 3,903,790; U.S. Ser. No. 672,862, filed Apr. 2, 1976.

BACKGROUND OF THE INVENTION

Household compactors have been well received since they enable the bulk of trash deposited in a plastic bag to be so reduced that trash can be disposed of conveniently.

While one type of household compactor has a door for use in the introduction of trash that is separate from whatever means are employed to close the chamber in which the trash is compacted, a more common type has a door hinged to one side of its housing and which, when opened permits trash to be deposited or the compacted trash to be removed. Such doors have been provided with auxiliary doors for use only for the entry of trash and functioning as chutes therefor when opened.

It is a practical requirement that all the trash entered in a compactor lands in the path of the compacting head. For that reason, in some constructions, the door or the auxiliary door is provided with a rearwardly disposed portion operable to push into the path trash that would otherwise remain in back of the door and such a portion can be a part of a throat in which compacting can safely occur if the trash builds up rearwardly of the door.

While the present invention is primarily concerned with auxiliary doors to be incorporated in the doors of compactors of the second type, doors in accordance therewith are equally well suited for use in compactors in which separate closures are used, one for entry of trash and another for the removal of compacted trash. For convenience, the term "auxiliary door" is used herein to designate doors in accordance with the invention for either type and, additionally the term "panel" is used to include either a door serving both for trash entry and compacted trash removal or a front wall portion of a compactor housing. In addition, the term "throat portion" is used herein to mean both a portion the sole function of which is to push trash into the path of the compactor or a front portion of a throat in which compacting can occur and which is capable of withstanding attendant compacting pressures.

THE PRESENT INVENTION

The general objective of the present invention is to provide an auxiliary door that combines the functions of serving as a chute, when opened, and as a throat portion, when closed, an objective attained with an auxiliary door having first and second parts. The first part has a front wall and parallel sides extending rearwardly thereof. A second part has a rear wall and upper and lower end walls hingedly connected to the ends thereof. The lower end wall is secured to the main door marginally of the lower edge of a port or doorway therein and with the end of the upper wall hingedly connected to the first part adjacent the upper end thereof.

When the auxiliary door is closed, the rear wall of the second part is substantially flush with the inner edges of the sides of the first part and its end walls are at right angles to the front wall thereof. When, however, the auxiliary door is opened, the second part collapses with its rear wall spaced below the edges of the sides of the first part so that the opened door becomes a trash-receiving chute having side walls.

Another objective of the invention is to provide second parts that are inexpensive, easily replaced units, an objective attained by molding them of a suitable plastic, in practice polypropylene and thick enough to serve as walls and so that when molded with transverse channels of a predetermined depth, flexible linear hinges are established. Each part has such hinge lines spaced to define the rear and the upper and lower end walls and enable them to fold in the same directions relative to the plane that part originally had when molded. Additionally, each part includes end sections defined by hinge-forming transverse channels with the end section for the upper end wall defined by a hinge-establishing transverse channel enabling that end section to fold in a direction opposite to that which the other hinges permit.

Yet another objective of the invention is to provide means yieldably to hold the auxiliary door closed, an objective attained with a tension spring anchored to the rear wall and to the upper end wall of the second part at positions such that the spring is operative to ensure the closing of the auxiliary door to erect the second part and yieldably oppose its collapse.

BRIEF DESCRIPTION OF THE DRAWINGS

The accompanying drawings illustrate a preferred embodiment of the invention and FIG. 1 is a side view of a compactor provided with an auxiliary door in accordance with the invention with a side wall of the compactor housing partly broken away and with the auxiliary door opened part way;

FIG. 2 is a side view of the auxiliary door as it appears when fully opened;

THE PREFERRED EMBODIMENT OF THE INVENTION

Figure 3:
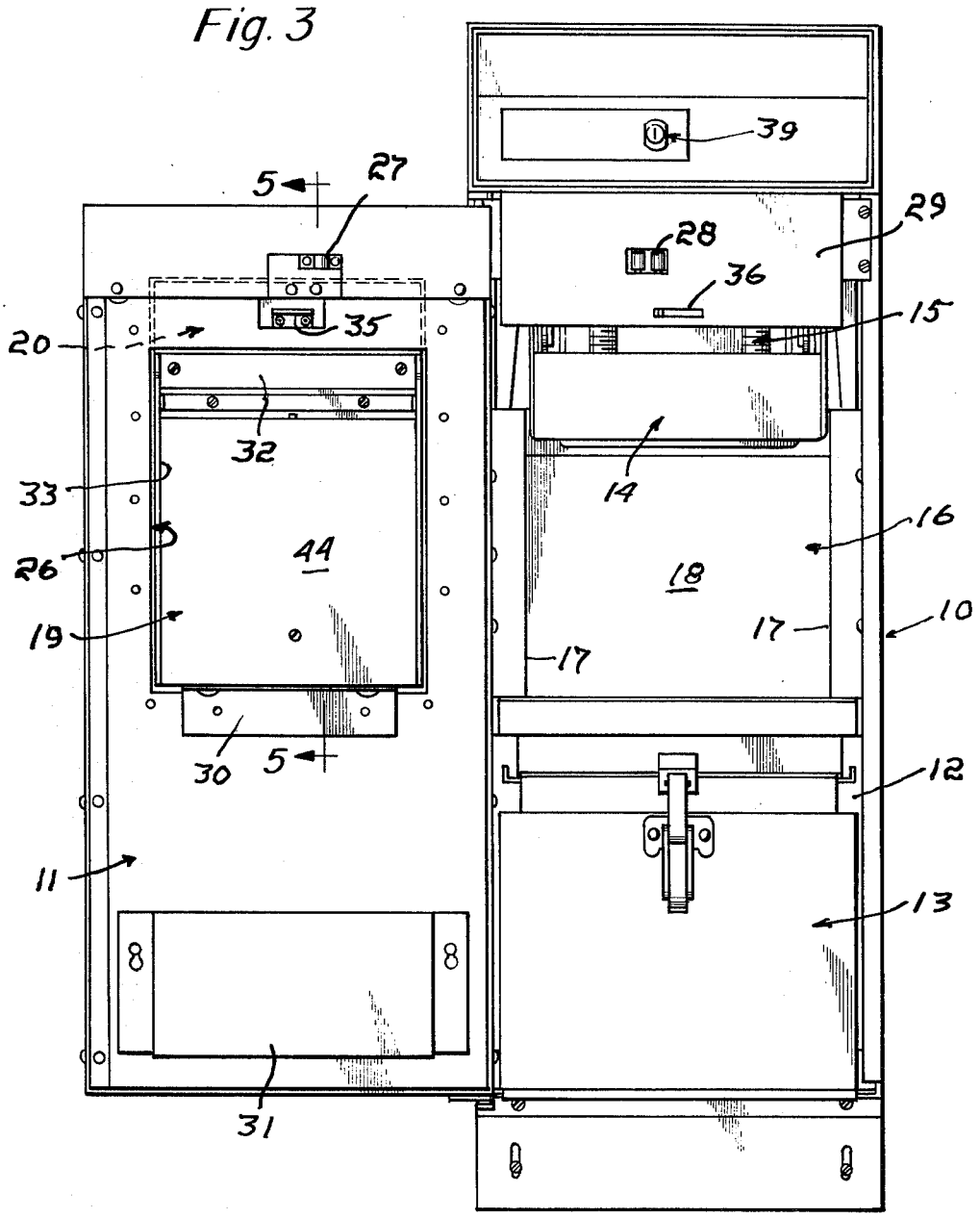
FIG. 3 is a front view of the compactor with its door open to expose the auxiliary door.

The housing of a trash compactor is generally indicated at 10 and has a door 11 hingedly connected to one side thereof. The compactor has a chamber 12 for a removable receiver 13 of a type operable to hold open a disposable trash bag (not shown) in a position to receive the trash to be compacted therein. The compacting of the trash is effected by the compacting head 14 operated by means mounted in the upper part of the compactor and generally indicated at 15 to reciprocate the compacting head 14 between an upper inoperative position and lower compacting positions determined by the build-up of the trash.

The construction of the housing 10, the means 15 for reciprocating the compacting head 14, and the receiver 13 are not detailed as forming no part of the present invention. For details of their construction reference is made to copending application Ser. No. 659,126, filed Feb. 18, 1976 and U.S. Pat. Nos. 4,000,689 and 3,979,008.

As it is necessary to ensure that all the trash discharged into the compactor is deposited within the bag held by the receiver 13, the housing 10 is provided with a throat generally indicated at 16 which overlies the margins of the receiver 13, and, as trash may build up into the throat, it is of a construction such that it can withstand pressures attendant the compaction of such a build-up of trash. The throat is shown as consisting of side portions 17, a rear end portion 18, and a front portion generally indicated at 10 and carried by the door 11.

While the construction of the throat portions 17 and 18 form no part of the present invention and are detailed in the above referred-to copending applications, the front portion 19 is part of an auxiliary door in accordance with the present invention and generally indicated at 20 with which the door 11 is provided to permit trash to be deposited in the compactor without opening the door 11.

The door 11 is shown as having a handle 21 extending transversely of its upper end and including a downwardly opening channel 22, marginal trim 23 and front and rear panels 24 and 25 encased by the trim 23 and the channel 22 and connected thereto in a spaced apart relationship. The panels 24 and 25 have, see FIG. 5, rectangular openings 24A and 25A defining a generally indicated port or doorway 26 opening into the throat 16.

The rear face of the handle 21 is provided with a latch 27 disposed to engage with and be held, when the door 11 is closed, by a catch 28 mounted on a plate 29 at the upper end of the front of the housing 10. A bracket 30 is attached to the rear panel 25 transversely of the lower edge of the opening 25A and a holder 31, for trash bags, a deodorizer, or both, is detachably supported by the rear panel 25 in a position to occupy the outer end of the chamber 12 when the door 11 is closed.

Figure 6:
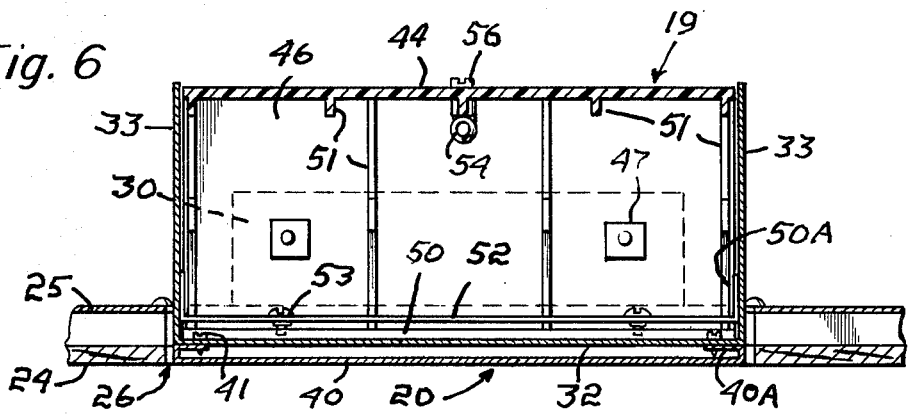
FIG. 6 is a section taken approximately along the indicated line 6—6 of FIG. 5.
Figure 4:
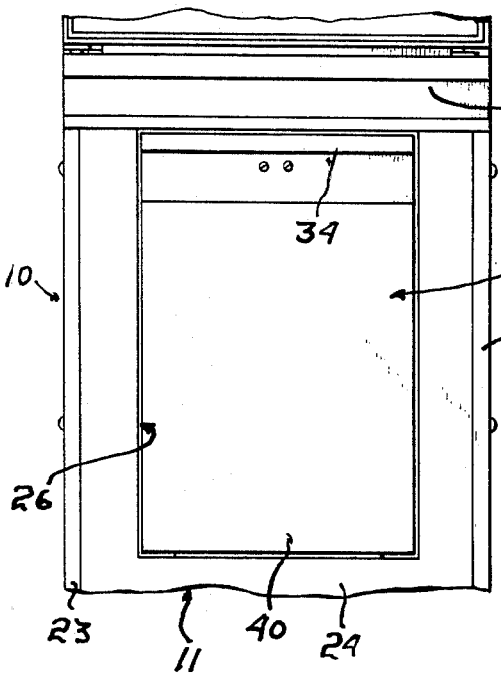
FIG. 4 is a fragmentary view of the front of the compactor with both doors closed.
Figure 5:
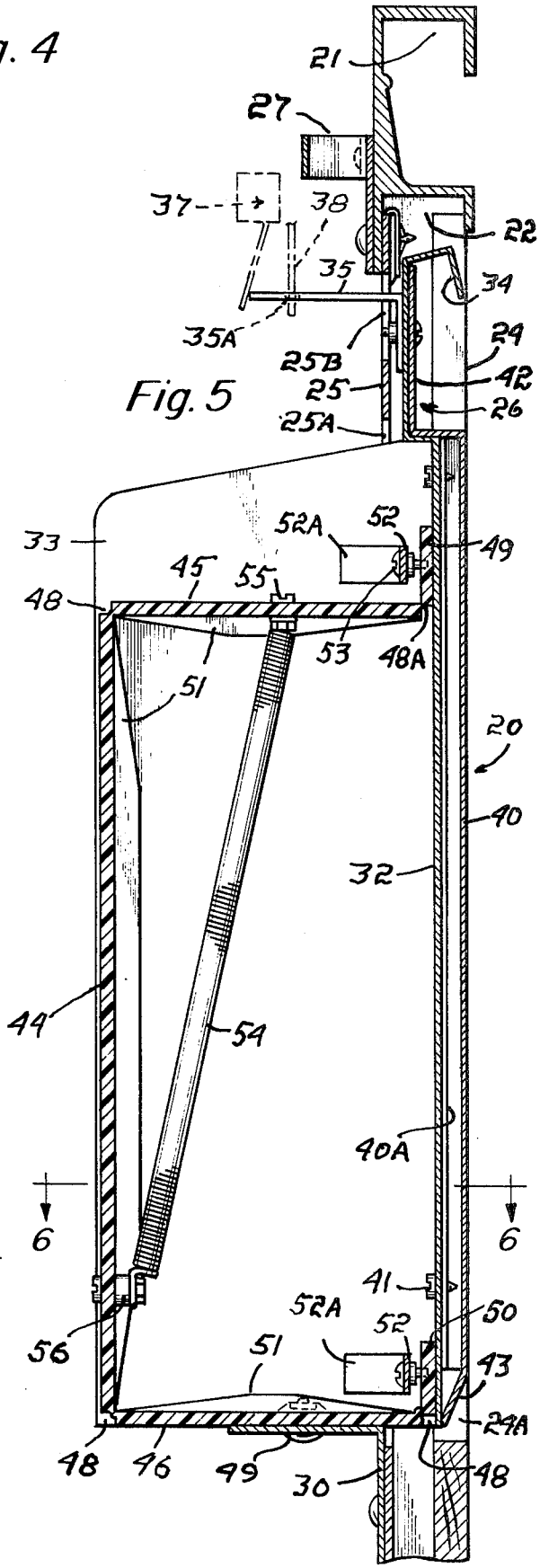
FIG. 5 is a section on a substantial increase in scale and taken approximately along the indicated line 5—5 of FIG. 3.

The auxiliary door 20, see FIGS. 5 and 6, consists of a first and second parts, the front part a welded assembly having a front wall 32 and side walls 33 extending rearwardly to provide the sides of the throat portion 19. The front wall 32 includes an upper end portion shaped to establish a transverse handle 34 shown as fitting under the handle 21 when the door 20 is closed.

The auxiliary door handle 34 has a rearwardly disposed probe 35 extending through a slot 25B in the rear panel of the door 11 in a position to enter, when the door 11 and the auxiliary door 20 are both closed, a slot 36 in the plate 29, then to engage and close a normally open safety switch indicated at 37 in the operating circuit for the drive 15 for the compacting head. The probe 35 has a hole 35A which receives a locking member indicated at 38 whenever the key-operated starting switch 39 is operated, reference again being made to said copending application for circuit and associated details.

It will be noted that the front wall 32 of the auxiliary door 20 is spaced inwardly relative to the outer face of the panel 24 of the door 11. A cover plate 40 has its side edges of U-shape cross section providing inner margins 40A connected to the wall 32 by screws 41 and spacing the plate 40 flush with the panel 24. The upper end 42 fits within the handle 34 and the lower end 43 which is downwardly and rearwardly inclined against the lower end of the front wall 32.

The second part of the auxiliary door 20 is a hinged assembly including a rear wall 44, an upper wall 45 and a lower wall 46, the walls 44 and 45 hingedly connected to the rear wall 44 to fold forwardly at right angles relative thereto and with the lower wall 46 bolted to the bracket 30 as at 47 and the upper wall 45 hingedly connected to the first part so that it can fold downwardly relative to the front wall 32 as the auxiliary door is opened. The width of the walls 44, 45, and 46 is such that they are a free but close fit between the sides 33.

In practice the second part of the auxiliary door 20 is a molded length of plastic, polypropylene, for a preferred example, of substantial thickness such that it is stiff enough to serve as throat material and having transverse channels molded therein of a depth such that flexible webs are established that provide substantially linear hinges 48. The hinge-forming channels are spaced apart to establish the walls 44, 45, and 46 and additionally end sections 49 and 50. The channel forming the hinge 48A between the upper wall 45 and the end portions 49 is opposite to the channels forming the hinges 48. Desirably and as shown, the walls 44, 45, and 46 are formed with reinforcing ribs 51 extending lengthwise of their inner surfaces, the ribs 51 tapering towards the adjacent linear hinges 48 to minimize the extent to which they interfere with the folding of the walls towards each other.

The second part is shown as attached to the first part by upper and lower holders 52 having end portions 52A welded to the sides 33 of the first part. The end section 50 is disposed upwardly between the front wall 32 and the lower holder 52 and is attached thereto by screws 53. The end section 59 is also disposed upwardly to be exposed above the upper wall 45 and is held against the front wall 32 when connected to the upper holder 52. The holders 52, as thus employed make assembly and service convenient and replacement of the second part should it, for any reason, become damaged and, additionally make it unnecessary to have screws extending through the front wall 32 in the event an auxiliary door is not to have a cover plate 40.

A tension spring 54 is anchored as at 55 to the upper wall 45 and as at 56 to the rear wall 44 yieldably holding the second part erected. As the auxiliary door 20 opens, the second part collapses to position the walls 44 and 45 below the edges of the sides 33 thus establishing a trash chute. The spring 54 is operative to ensure that the auxiliary door 20 closes, once it is released by the user, with the second part erected to reestablish the throat portion 19.

I claim:

1. A household trash compactor including a housing having a chamber in which a bag is to be held open to receive trash, compacting means includig a compacting head and a drive operable to reciprocate said head between an upper inoperative position and lower compacting positions which depend on the extent of the trash build-up, a front panel having a port opening into the compactor below but adjacent said inoperative position, and a door closing said port and including first and second parts, said first part including a front wall and sides which extend into the compactor a predetermined extent when the door is closed, said second part including a rear wall and upper and lower end walls hingedly connected thereto, means extending transversely of the bottom of the port to which the lower end wall is fixed, and a hinge connection between the upper end wall and said first part, said rear wall, when the door is closed, positioned substantially flush with the inner edges of the sides of said first part and, as said door is pulled open, said second part collapsing to bring said first and second parts into a chute-establishing relationship.

2. The trash compactor of claim 1 in which the front panel is a main door and the door closing the port therein is an auxiliary door.

3. The trash compactor of claim 2 in which the trash compactor includes an electric circuit having a normally open switch and an operator controlled switch, the auxiliary door includes a probe operable to close said normally open switch when the main and auxiliary doors are closed, and a lock operable to connect the auxiliarly door to the compactor when both doors are closed and the operator controlled switch is also closed.

4. The trash compactor of claim 1 and a spring connecting the rear and upper walls of the second part and operable yieldably to hold the port-closing door closed.

5. The trash compactor of claim 4 in which the width of the walls of the second part are a free but close fit between the side walls of the first part.

6. The trash compactor of claim 1 in which the second part includes a length of a plastic of a thickness capable of resisting pressures attendant the compaction of trash rearwardly of the door and having tranverse channels spaced and arranged to define the second part walls and of a depth to establish hinge-forming webs.

7. The trash compactor of claim 6 in which the plastic is one having the qualities of polypropylene as to pressure-resistance and hinge forming.

8. The trash compactor of claim 6 in which the length includes end sections and transverse hinge-forming channels separating each end section from the appropriate one of the upper and lower walls, and means connecting said end sections to the first part.

9. The trash compactor of claim 8 in which the transverse channels defining the end sections extend into the plastic in opposite directions such that both end sections fold upwardly each relative to the wall to which it is connected, and the means connecting the end sections to the first part are holders, one for each end section and anchored to the side walls of the first part.

10. The trash compactor of claim 9 in which each holder is spaced rearwardly of the front wall of the first part and each end section extends upwardly between the appropriate holder and said front wall and is held thereagainst when connected to the holder therefor.

* * * * *